US005791267A

United States Patent [19]

Martin et al.

[11] Patent Number: 5,791,267

[45] Date of Patent: Aug. 11, 1998

[54] WASTE PYROLYSIS PROCESS AND INSTALLATION HAVING A PREHEATING UNIT

[75] Inventors: Gérard Martin; Eric Marty, both of Rueil-Malmaison, France

[73] Assignee: Institut Francais du Petrole, Rueil Malmaison, France

[21] Appl. No.: 451,266

[22] Filed: May 30, 1995

[30] Foreign Application Priority Data

May 30, 1994 [FR] France ..... 94 06661

[51] Int. Cl.[6] ..... F27B 7/00

[52] U.S. Cl. ..... 110/246; 432/103; 432/105

[58] Field of Search ..... 432/103, 105; 110/246, 236, 226

[56] References Cited

U.S. PATENT DOCUMENTS

| | | | |
|---|---|---|---|
| 1,508,578 | 9/1924 | Ruhr . | |
| 3,481,720 | 12/1969 | Bennett . | |
| 3,865,541 | 2/1975 | Wilson et al. | 432/103 |
| 4,066,024 | 1/1978 | O'Connor . | |
| 4,245,571 | 1/1981 | Przewalski | 110/246 |
| 5,085,581 | 2/1992 | Mendenhall | 432/103 |
| 5,188,041 | 2/1993 | Noland et al. | 110/246 |
| 5,302,118 | 4/1994 | Renegar et al. | 110/246 |
| 5,454,715 | 10/1995 | Hansen et al. | 432/103 |

FOREIGN PATENT DOCUMENTS

| | | |
|---|---|---|
| 0 446 930 | 2/1983 | European Pat. Off. . |
| 0 485 255 | 5/1992 | European Pat. Off. . |
| 3 233 121 | 3/1984 | Germany . |

*Primary Examiner*—Andrew M. Dolinar

*Attorney, Agent, or Firm*—Antonelli, Terry, Stout, & Kraus, LLP

[57] ABSTRACT

The present invention relates to an installation intended for the pyrolysis of solids, comprising a rotary furnace (1) inside which pyrolysis is achieved, and a means (21) for heating the rotary furnace. The installation according to the invention further comprises a means (2) for preheating the solids, located upstream from said furnace, said means (2) comprises at least two zones (2a, 2b) in which the solids are preheated at different temperatures and a gas extraction device (12) into which the pyrolysis gases are led after passing through at least one of said preheating zones (2a, 2b).

9 Claims, 1 Drawing Sheet

1
1a
2
2a
2b
2c
3
4
5
6a
6b
7a
7b
8a
8b
9
10
11
12
13
14
15
20
21
22
22a
23
24
25
26
T

WASTE PYROLYSIS PROCESS AND INSTALLATION HAVING A PREHEATING UNIT

BACKGROUND OF THE INVENTION

The present invention relates to the field of thermal treatment of solid materials, and more specifically to pyrolysis (or thermolysis) furnaces intended for treating solids such as industrial and/or household waste.

Most of the known furnaces or installations consist of a furnace, stationary or rotary, provided with heating means that are most often located outside the furnace.

French patent application FR-2,668,774 describes a cylindrical furnace that rotates about a horizontal axis and that is heated by burners located in an annular space around the furnace.

This type of installation proves to be a big energy consumer since a very great mass of solids has to be brought to temperatures that may reach 800° C.

SUMMARY OF THE INVENTION

The present invention aims to improve notably, but not exclusively, this type of rotary furnace by decreasing mainly the energy requirements, the costs, and by simplifying the general design of the installation.

Specifically, the present invention allows self-cleaning of the pyrolysis gases, as explained hereafter.

The present invention advantageously allows to treat waste of very varied nature and humidity.

Service flexibility and modularity are also obtained according to the invention.

In order to reach the objectives and advantages stated above, the object of the present invention is an installation intended for the pyrolysis of solids, comprising a rotary furnace inside which pyrolysis is achieved, and a means for heating the rotary furnace.

According to the invention, the installation further comprises a means for preheating the solids, located upstream from said furnace, said means comprises at least two zones in which the solids are preheated at different temperatures, and a gas extraction device into which the pyrolysis gases are led after passing through at least one of said preheating zones, a sealed connection being also provided between said rotary furnace and said preheating means.

Advantageously, the installation also comprises a means intended for adjusting individually the temperature in each preheating zone and in said rotary furnace.

Preferably, the temperature inside said preheating means is so adjusted that it is always less than a given temperature $T_0$.

Without departing from the scope of the invention, the pyrolysis gas extraction device is arranged between two preheating zones, in relation to the direction of propagation of the solids in the installation.

According to an embodiment of the invention, the extraction device also allows the separation and/or the discharge of certain solids.

More precisely, the preheating means can be tubular, of substantially horizontal axis, and it can comprise a narrowing at its end associated with the connection with the furnace.

The installation according to the invention can also comprise a means located upstream from said rotary furnace, intended for injecting a basic element in the solids.

In accordance with the invention, a device intended for discharging the pyrolysis gases in case of an emergency can also be provided.

The present invention is further aimed at the pyrolysis process associated with the installation.

Application to the pyrolysis of industrial and/or household waste is more particularly aimed by the invention.

BRIEF DESCRIPTION OF THE DRAWING

Other features, advantages and improvements will be clear from reading the description hereafter, given by way of non limitative example, of an embodiment of the invention, with reference to the accompanying sole drawing.

This figure diagrammatically shows, in a longitudinal section, an installation according to the invention.

DESCRIPTION OF THE PREFERRED EMBODIMENTS

Figure 1:
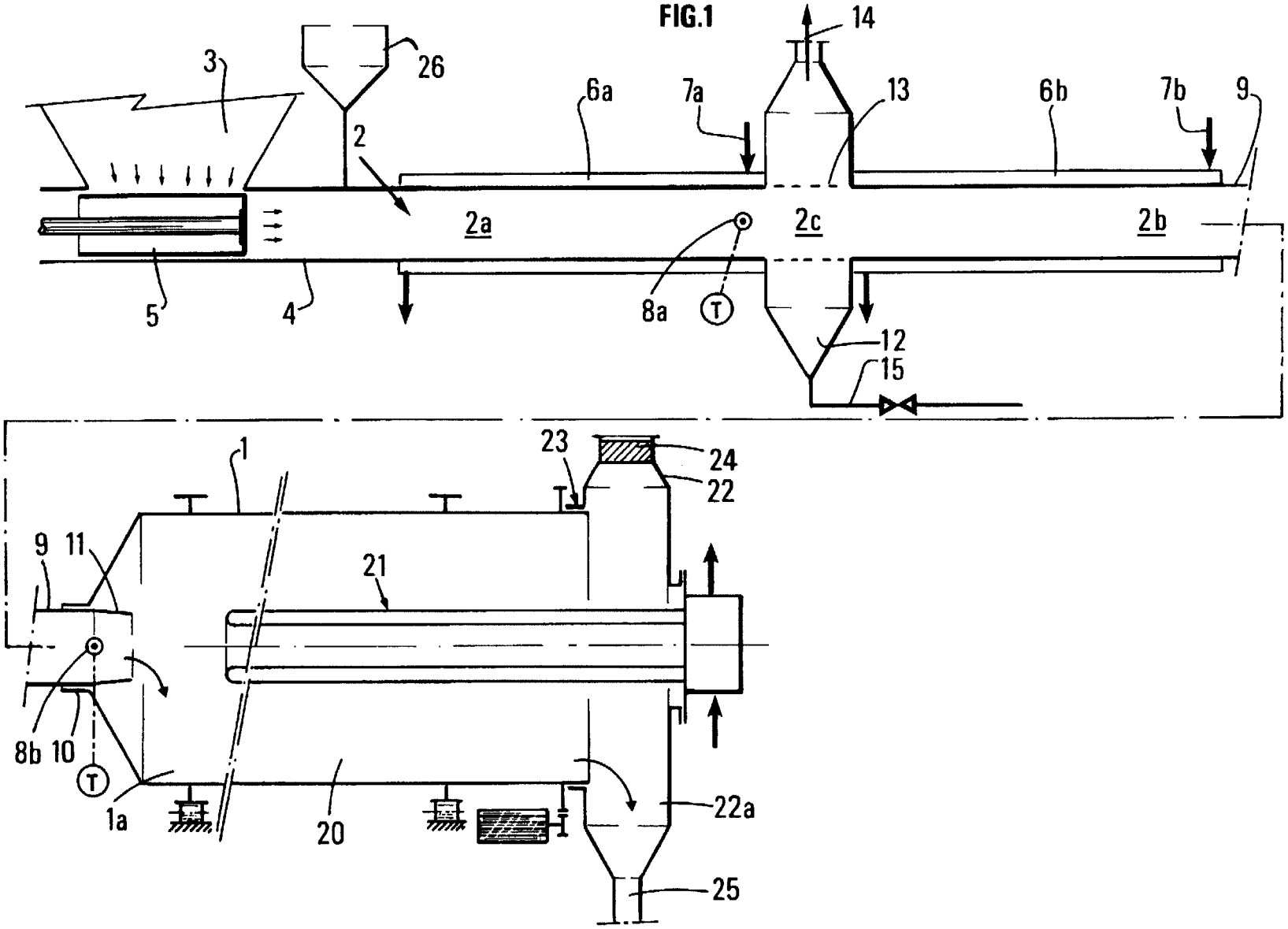

The installation comprises a rotary part 1 preceded by a means 2 for preheating the waste, of elongated shape and substantially cylindrical, said means 2 being supplied with waste from a hopper 3 via a transfer line 4.

The waste coming from hopper 3 is measured out, compacted, then pushed into transfer line 4 by a tappet 5 or any other device known to the man skilled in the art and capable of fulfilling the same purpose.

The waste enters a first zone **2*a* of preheating means 2. Heating of the waste can be provided indirectly therein by a heating jacket 6*a* swept by a hot fluid flowed in through a line 7*a*** or by the combustion of an appropriate fuel inside said jacket.

The first zone **2*a*** of the preheating means is used for removing a large part of the humidity contained in the waste, and for preheating it up to a temperature ranging between 50° and 150° C., preferably between 60° and 90° C.

Preferably, the temperature of the waste at the outlet of zone **2*a* is measured by means of a probe 8*a*, and the information obtained is used for regulating the heat input provided to heating jacket 6*a***.

Heating of the waste continues then in a second zone **2*b* of the preheating means 2 according to a process substantially equivalent to that of the first zone 2*a*, i.e. with a heating jacket 6*b* supplied with hot fluid through a line 7*b*. In the second zone 2*b*, the humidity remaining after the first zone 2*a*** is removed, and the waste is brought to a temperature ranging between 100° and 500° C., preferably between 140° and 200° C.

The temperature at the outlet of the second zone **2*b* is advantageously controlled by means of a probe 8*b* and the information obtained is used for regulating heating means 6*b***.

The end 9 of the second preheating zone **2*b* is connected to the rotary part 1 by means of a seal 10. End 9 can be equipped with a narrowing 11 intended for keeping a compact waste flowage inside transfer line 4 and in preheating pipe 2**.

A gas extraction device 12, a priori non-heated but thermally insulated, is arranged between zones **2*a* and 2*b*, at the level of a zone bearing reference number 2*c***.

This extraction device 12 receives the steam produced by the waste in parts **2*a* and 2*b* and the pyrolysis gases produced in the rotary cylinder 1, after the latter have flowed through the waste bed present in zone 2*b*** in a countercurrent flow.

To fulfil this function, extraction device 12 comprises means 13 such as porous surfaces, ports, grates, or any other equivalent means, allowing passage of the gases from the part 2c of the preheating pipe 2 towards said extraction device without carrying along notable amounts of solid matters.

The pyrolysis gases and the steam are then flowed out of device 12 by means of line 14 while the solids that possibly accompany the gases can be separated therefrom by sedimentation in device 12 or by any other means known to the man skilled in the art, and then discharged through a line 15.

After leaving preheating means 2, the waste falls into the rotary cylinder 1 by gravity and forms a bed 20 therein. Rotary cylinder 1 is more or less inclined according to the desired solids inventory and rate.

This rotary cylinder 1 can be heated by means located outside such as burners using for example pyrolysis gases, or by means 21 placed directly inside the rotary cylinder as shown in the appended single drawing. In this case, the heating means 21, mounted on a stationary part 22, can consist for example of a nested tube in which a combustion of a fuel such as natural gas or pyrolysis gases free of the main part of the tars and the particles is performed. The nested tube can also be supplied with a hot fluid obtained for example by air heating in the furnace burning the pyrolysis gases. The stationary part 22 is connected to the rotary part 1 by means of a joint 23 which forms a perfect gas seal between the ambience prevailing in said cylinder 1 and the outside.

Advantageously, the stationary part 22 can be equipped with a device 24 intended for the emergency evacuation of the pyrolysis gases, in case the flow of pyrolysis gases is strongly slowed down or if they can no longer flow through pipe 2b or through extraction device 12.

In the rotary cylinder 1, the waste is treated at temperatures ranging between 150° and 900° C., and preferably between 400° and 600° C. The waste moves forward from the inlet 1a to the stationary part 22. The resulting solid phase is concentrated in part 22a, then discharged through a line 25.

A hopper 26 intended for injecting a basic element (absorbent) in the waste can also be mounted on preheating means 2, preferably in zone 2a.

It will be clear that the interest of the preheating pipe (or means) is to dry the waste, then to heat it up to a temperature close to but less than the temperature $T_0$ from which the waste emits toxic substances such as chlorinated products, which must imperatively be trapped in the solid phase present in the rotary part.

It is important that the gas phase in the rotary furnace 1 is homogeneous, and it could be advantageous to use means known to the man skilled in the art to intensify the circulation of the gases in said rotary part and to improve the stirring of the gases and of the solids.

Besides, it is important to note that, when the pyrolysis gases percolate through the waste in the part 2b of the preheating pipe, they take part in the heating of the waste. Lowering of the temperature of the pyrolysis gases in this part leads to the condensation of the tars and to the trapping of certain acid compounds such as hydrochloric acid by the basic substances deliberately added to the waste, or which more generally accompany most of the industrial and household waste. A retention of the finest particles also occurs in the waste bed. The result of this stage of "filtration" by the waste bed is a gas free of its polluting elements, of the tars and of the dusts, a gas that can for example be reused immediately in heating device 21.

The original feature of the device according to the invention can be illustrated by the following example:

Household waste is treated with a device identical to that of the appended figure. The waste exhibits 30% of humidity. The three heating zones are so adjusted that the temperatures are respectively 100°, 150° and 500° C. at the outlet of parts 2a, 2b and 1. When the waste is in part 2a, it has lost approximately 50% of humidity. Setting aside the heat losses, the energy supplies at the level of devices 6a, 6b and 21 are respectively 0.523, 0.268 and 0.368 MJ/kg of treated waste.

In the case of a conventional rotary furnace without preheating pipe, the energy requirements would amount to 1.52 MJ/kg of waste. It should therefore be noted that, still setting aside the heat losses, the proposed system allows an overall energy gain of 25%, and that the energy consumption at the level of the rotary part only amounts to 25% of its value with the conventional rotary furnace.

As a result of the description above, the most significant advantages of the device according to the invention are as follows:

- self-cleaning of the pyrolysis gases by percolation of the gases through the waste bed 2b present in the preheating means, with notably removal of the tars by condensation (the latter can perform several up-and-down trips between the rotary part and the preheating pipe, but they are finally thermally cracked), with fixation of the residual non-trapped acid compounds at the level of the rotary part and with removal of the main part of the fine particles carried along by the gas, by filtration through the waste bed in the preheating pipe,
- lowering of the energy requirements of the operation through the use of a large part of the sensible heat of the pyrolysis gases for heating the waste on the one hand, and through a significant decrease in the size of the rotary part of the device, which is the main source of heat losses, on the other hand,
- cost decrease and simplification of the construction problems notably through a significant decrease in the size of the rotary cylinder in relation to conventional systems,
- possibility of treating waste of very varied nature and humidity through the presence of several heating zones (2a, 2b, 1) adjusted independently of one another.

We claim:

1. An installation for the pyrolysis of waste solids comprising a rotary furnace in which pyrolysis of the waste solid is effected, means for heating the rotary furnace to pyrolysis temperatures, means for preheating the solids located upstream from said furnace, said means for preheating the solids comprising at least two zones in which the solids are preheated at different temperatures and a pyrolysis gas extraction device into which pyrolysis gases are introduced after flowing from the rotary furnace and through at least one of said preheating zones, a seal connection provided between said rotary furnace and said preheating means, means for causing the waste solids to pass through the preheating means and into the rotary furnace, and means for adjusting individually the temperature in each of the preheating zones and in said rotary furnace, and wherein said pyrolysis gas extraction device is located between two preheating zones so that the waste solids initially pass through one of the two preheating zones, through the pyrolysis gas extraction device, and then through the other of the two preheating zones prior to entering the rotary furnace.

2. An installation according to claim 1, wherein the means for adjusting the temperature individually in each of the preheating zones controls the temperature inside said preheating means so that the temperature is always less than a given temperature $T_0$ at which the waste solids emit toxic substances.

3. An installation according to claim 1, wherein the pyrolysis gas extraction device also effects separation and discharge of limited amounts of solids from the installation.

4. An installation according to claim 1, wherein the means for heating the rotary furnace is arranged inside said furnace.

5. An installation according to claim 1, wherein the preheating means comprises a tubular pipe having a substantial horizontal axis, said pipe having a narrowed end portion discharging the waste solids through the sealed connection located between the rotary furnace and the preheating means.

6. An installation according to claim 1 further comprising means located upstream from the rotary furnace for injecting a basic element into the solids within said preheating means for absorbing toxic materials from the pyrolysis gases.

7. An installation according to claim 1 further comprising a device for discharging pyrolysis gases from the rotary furnace in case of an emergency.

8. An installation according to claim 1, wherein the means for preheating the solids comprises a heating jacket surrounding the one of the two preheating zones so that said one zone is heated between 60° and 90° C. and the other of the two preheating zones includes a heating jacket for heating the other of the two heating zones to a temperature ranging between 100° and 500° C.

9. An installation according to claim 1, wherein said pyrolysis gas extraction device includes an outlet through which pyrolysis gases produced in the rotary furnace after flowing through the other of the two preheating zones are discharged from the gas extraction device, whereby the pyrolysis gases are cleaned by percolation through the solid waste contained in said other preheating zone.

* * * * *